US008256349B2

(12) United States Patent
Moore

(10) Patent No.: US 8,256,349 B2
(45) Date of Patent: Sep. 4, 2012

(54) TRACKING SYSTEM FOR BLAST HOLES

(75) Inventor: John Vincent Moore, Lathlain (AU)

(73) Assignee: Global Tracking Solutions Pty Ltd., Lathlain (AU)

( * ) Notice: Subject to any disclaimer, the term of this patent is extended or adjusted under 35 U.S.C. 154(b) by 331 days.

(21) Appl. No.: 12/519,681

(22) PCT Filed: Dec. 18, 2007

(86) PCT No.: PCT/AU2007/001957

§ 371 (c)(1),
(2), (4) Date: Dec. 21, 2009

(87) PCT Pub. No.: WO2008/074071

PCT Pub. Date: Jun. 26, 2008

(65) Prior Publication Data

US 2010/0116165 A1 May 13, 2010

(30) Foreign Application Priority Data

Dec. 18, 2006 (AU) ..... 2006907079

(51) Int. Cl.
*F42D 1/00* (2006.01)
*F42D 3/00* (2006.01)
*F42D 3/04* (2006.01)

(52) U.S. Cl. ..... 102/312; 102/301; 102/313

(58) Field of Classification Search ..... 102/301, 102/311, 312, 313
See application file for complete search history.

(56) References Cited

U.S. PATENT DOCUMENTS

| | | | | |
|---|---|---|---|---|
| 6,079,333 | A | 6/2000 | Manning | |
| 6,941,870 | B2 | 9/2005 | McClure et al. | |
| 7,492,279 | B2 * | 2/2009 | Uitto | 340/853.3 |
| 7,578,237 | B2 * | 8/2009 | Johnston et al. | 102/217 |
| 7,975,613 | B2 * | 7/2011 | Labuschagne et al. | 102/217 |
| 2004/0225431 | A1 | 11/2004 | Aebi et al. | |
| 2005/0263027 | A1 | 12/2005 | Johnston et al. | |

FOREIGN PATENT DOCUMENTS

| | | | |
|---|---|---|---|
| EP | 0 897 098 | A2 | 2/1999 |
| WO | WO2005/052498 | A1 | 6/2005 |
| WO | WO2006/076777 | A1 | 7/2006 |
| WO | WO2006/086843 | A1 | 8/2006 |

OTHER PUBLICATIONS

International Search Report of corresponding international Application No. PCT/AU2007/001957, mailed Jan. 25, 2008.

* cited by examiner

*Primary Examiner* — James Bergin
(74) *Attorney, Agent, or Firm* — Alston & Bird LLP

(57) ABSTRACT

A system and method is provided for identifying any one or more of a plurality of blast holes in a drill pattern. The method involves providing each blast hole in a drill pattern with an individually identifiable first identifier and a GPS device capable of relaying identification and location data for the respective blast hole. A data reception system is provided to receive the data and store it in a database for processing purposes. The information may be later used to correlate any one or more of the blast holes with a corresponding detonator.

14 Claims, 3 Drawing Sheets

TRACKING SYSTEM FOR BLAST HOLES

FIELD OF THE INVENTION

The present invention relates to a method and system for identifying blast holes, in particular to a method and system for remotely identifying blast holes and correlating the blast holes with corresponding detonators and associated explosives.

BACKGROUND OF THE INVENTION

In open cut or underground mining operations, a drilling and blasting engineer typically designs a drill pattern for a blasting site based on parameters such as rock burden including rock type and density, spacings between blastholes, borehole depth and diameter for a predetermined explosive material, and where required, blasthole orientation and angles.

In some instances the drill pattern is then surveyed and pegged out by the drilling team. Each blasthole peg is tagged and provided with a unique blasthole number. The driller drills the blastholes in accordance with the drill pattern and manually records each blasthole number and respective blast hole depth. Alternatively, the drill pattern is transferred electronically to a drill rig which then uses a global positioning system (GPS) to locate and identify positions of each blast hole.

Prior to commencement of loading of the blastholes with explosives, all blast holes are typically reinspected with respect to conformance to drill pattern including the consistency of hole sizing and depth and orientation of the blast holes. If any blast holes are found to be too shallow, too deep, out of position or there is a requirement for extra holes due to excessive burden, then this information is conveyed back to the drilling and blast engineer to authorise corrective action as soon as practicable.

After drilling, samples from each blast hole are taken for mineral testing, each sample being tagged with the corresponding unique blast hole number. The blast hole number is then retrieved from each bag and loaded into a data tracking system.

The blast crew then manually records the blast hole loading data comprising date, time, shot firer, pattern number, blast hole number, individual blast hole depth, quantities and relative bulk strength of explosive material loaded into each blast hole, delay number, number of detonators or primers loaded into the blast hole, stemming height, and returns the blast hole loading data to the drilling and blasting engineer.

Typically, a correlation of blast holes against explosive materials is then made by checking that the number of holes loaded with explosives corresponds to the number of holes drilled. This information is then cross-referenced against magazine stock records to check if all explosive materials is accounted for, and the data is then cross-referenced against the drill pattern. As the two sets of information recorded by the driller and the blast crew are manually recorded, it is a time consuming process to transfer this data to a computer in order to complete the resolution process, and subject to human error.

The present invention seeks to overcome at least some of the aforementioned disadvantages.

SUMMARY OF THE INVENTION

In its broadest aspect, the invention provides a system and method for identifying any one or more of a plurality of blast holes in a drill pattern.

In one aspect of the invention there is provided a system for remotely identifying any one or more of a plurality of blast holes in a drill pattern comprising:

a) a plurality of individually identifiable first identifiers capable of relaying identification data pertaining to the respective identifier;

b) a plurality of GPS devices capable of relaying information related to a location of the respective GPS device;

c) a plurality of blast holes configured in a drill pattern, each blast hole being provided with a respective first identifier and a GPS device; and, d) a data reception system for receiving identification data and location information from respective first identifiers and GPS devices for each blast hole.

In one embodiment of the invention, the first identifier is a machine-readable wireless device or transponder, such as for example, radio frequency signalling devices, magnetic bar codes, optical wires, and magnetic induction identification tags. Illustrative examples of radio frequency signalling devices include, but are not limited to, radio frequency identification device (RFID) tags, micro-RFID tags, macro RFID tags, nano-RFID tags, laser RFID tags active tags, passive tags, and semi passive RFID tags or other suitable RFID tags which are capable of transmitting data to a RFID integration device which can act as a transceiver and receiver.

In another embodiment of the invention, each first identifier has a unique identity. In one form the unique identity of the machine-readable wireless device or transponder comprises a unique machine-readable signal corresponding to a plurality of characters, symbols or other indicia.

The first identifier and the GPS device are disposed in a manner in respect to each blast hole such that the identity data corresponding to the first identifier and the location information corresponding to the GPS device are associated specifically with the blast hole. In one embodiment, the first identifier and the GPS device are attached to, or disposed in close proximity with, a blast hole peg associated with any one or more of the plurality of blast holes, or any one or more of the plurality of blast holes in the drill pattern.

The GPS device transmits a unique set of spatial coordinates for the blast hole with which it is associated. Accordingly, in an alternative embodiment of the invention, the first identifier comprises the GPS device.

In another embodiment, the data reception system comprises one or more data reception devices adapted for receiving identification data and location information relayed from respective first identifiers and GPS devices for each blast hole. The one or more data reception devices may be located at predetermined locations remote from the blast hole drill pattern and/or may be transportable into or out of the blast hole drill pattern.

In a further embodiment, the data reception system further comprises a database capable of receiving and storing identification data and location information transmitted from the one or more data reception devices.

In a second aspect of the invention there is provided a method of remotely identifying any one or more of a plurality of blast holes in a drill pattern comprising the steps of:

a) providing each of a plurality of blast holes with an individually identifiable first identifier capable of relaying identification data pertaining to the respective blast hole;

b) providing each of the plurality of blast holes with a GPS device capable of relaying information related to a location of the respective blast hole; and, c) receiving identification data and location information from said first identifier and GPS device, respectively, at a first data reception device.

In one embodiment of the invention, the method further comprises transmitting said identification data and location information received by said first data reception device to a database capable of receiving and storing identification data and location information transmitted from the data reception device.

In another embodiment of the invention, the step of receiving identification data from said first identifier comprises interrogating said first identifier with said first data reception device. In one form, interrogating is performed by transmitting a signal.

In a third aspect of the invention there is provided a computer program for remotely identifying any one or more of a plurality of blast holes in a drill pattern, the computer program comprising instructions to control a processor to:

a) receive identification data and location information from a first identifier and a GPS device associated with any one of a plurality of blast holes in a drill pattern; and, b) correlate the identification data and location information pertaining to the blast hole with the drill pattern.

In a further aspect of the invention there is provided a computer readable storage medium comprising the computer program as defined above.

The inventor of the present invention has also realised that the system and method of the present invention may be readily adapted to allow the blast holes in a drill pattern to be correlated with a respective detonator, and thereby track and monitor the whereabouts of the detonator on site.

Accordingly, in an alternative aspect of the invention there is provided a system of correlating any one or more of a plurality of blast holes in a drill pattern with a corresponding detonator, the system comprising:

a) a plurality of individually identifiable first identifiers capable of relaying identification data pertaining to the respective first identifier;

b) a plurality of GPS devices capable of relaying information related to a location of the respective GPS device;

c) a plurality of blast holes configured in a drill pattern, each blast hole being provided with a respective first identifier and a GPS device;

d) a plurality of individually identifiable second identifiers capable of relaying identification data pertaining to the respective second identifier;

e) a plurality of detonators, each detonator being provided with a respective second identifier, wherein each detonator is located in a respective blast hole in the drill pattern; and, f) a data reception system for receiving identification data and location information from respective first and second identifiers and GPS devices for each blast hole and corresponding detonator.

In one embodiment of the invention the first identifiers and the data reception system are as defined above.

In one embodiment of the invention the detonator comprises a detonator casing for housing a detonator mechanism and the second identifier, wherein the second identifier comprises an internal identifier disposed internally of the detonator casing and an external identifier disposed externally of the detonator casing. Advantageously, if the external identifier is removed from the detonator casing, the detonator may still be identified by the internal identifier. Typically, the internal and external identifiers are identical and unique to the detonator.

In one embodiment, the second identifier is a machine-readable wireless device or transponder, such as for example, radio frequency signalling devices, magnetic bar codes, and magnetic induction identification tags. Illustrative examples of radio frequency signalling devices include, but are not limited to, radio frequency identification device (RFID) tags, micro-RFID tags, macro RFID tags, nano-RFID tags, active tags, passive tags, and semi passive RFID tags or other suitable RFID tags which are capable of transmitting data to a RFID integration device which can act as a transceiver and receiver.

Each second identifier has a unique identity. In one form the unique identity of the machine-readable wireless device or transponder comprises a unique machine-readable signal corresponding to a plurality of characters, symbols or other indicia.

In a further aspect of the invention there is provided a method of correlating any one or more of a plurality of blast holes in a drill pattern with a corresponding detonator, the method comprising:

a) providing each of a plurality of blast holes with an individually identifiable first identifier capable of relaying identification data pertaining to the respective blast hole;

b) providing each of the plurality of blast holes with a GPS device capable of relaying information related to a location of the respective blast hole;

c) providing a detonator corresponding to each of the plurality of blast holes with an individually identifiable second identifier;

d) receiving identification data and location information from said first identifier and GPS device, respectively, at a data reception device;

e) receiving identification data from said second identifier at the data reception device; and, f) correlating the identification data and location information pertaining to each blast hole with the identification data pertaining to each corresponding detonator.

The present invention provides in a still further aspect a computer program for correlating any one or more of a plurality of blast holes in a drill pattern with a corresponding detonator, the computer program comprising instructions to control a processor to:

a) receive identification data and location information from a first identifier and a GPS device associated with any one of a plurality of blast holes in a drill pattern;

b) receive identification data from a second identifier associated with a detonator located in any one of the plurality of blast holes in the drill pattern; and, c) correlate the identification data and location information pertaining to each blast hole with the identification data pertaining to each corresponding detonator.

In a further aspect of the invention there is provided a computer readable storage medium comprising the computer program as defined above.

DESCRIPTION OF THE FIGURES ACCOMPANYING THE DESCRIPTION

Preferred embodiments, incorporating all aspects of the invention, will now be described by way of example only with reference to the accompanying drawings, in which.

DETAILED DESCRIPTION OF PREFERRED EMBODIMENT

Figure 1:
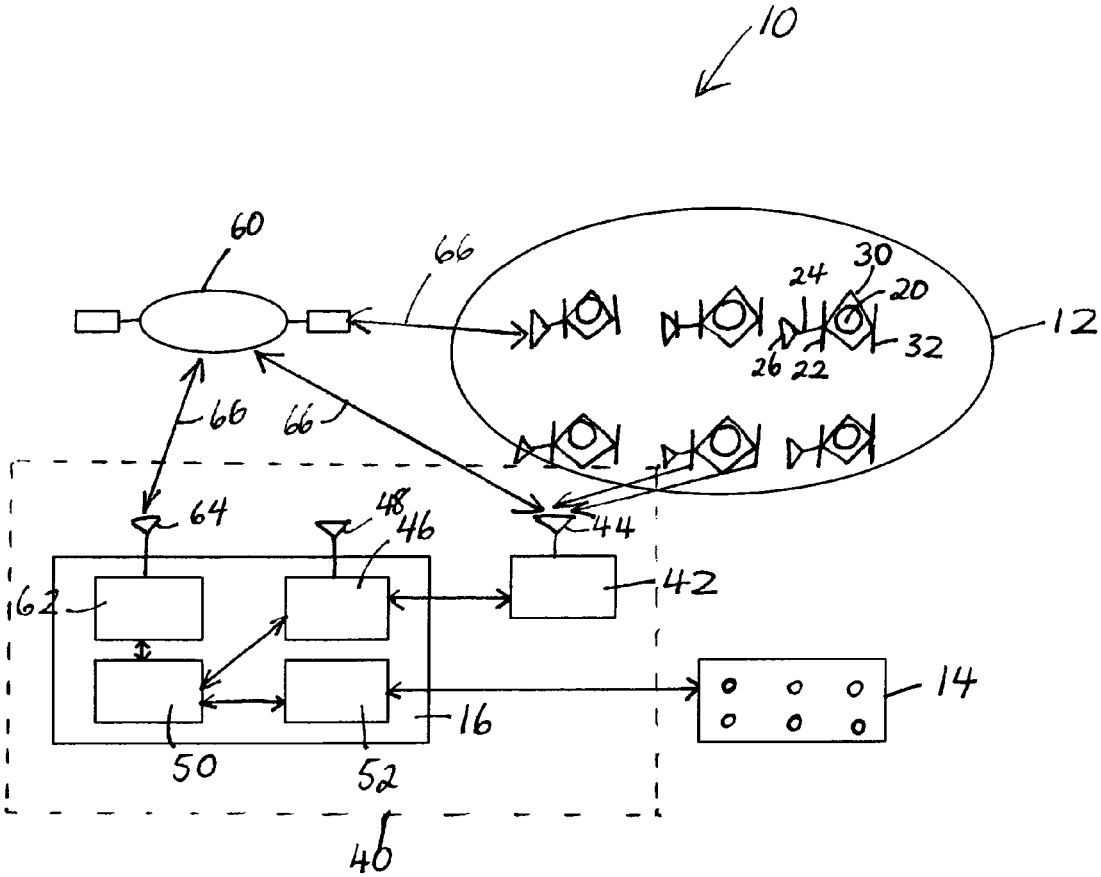
FIG. 1 is a block diagram of a system for identifying any one or more of a plurality of blast holes in a drill pattern in accordance with the present invention.

FIG. 1 is a block diagram of a system 10 for remotely identifying any one or more of a plurality of blast holes 20 in a drill pattern 12. The system 10 may be readily adapted to additionally correlate any one or more blast holes 20 in the drill pattern 12 with a corresponding detonator 30.

The term "drill pattern" as used herein refers to one or more holes arranged in an array in an open pit or underground type operation and is not limited to terrestrial terrain, but also includes ice formations and underwater operations.

Drill patterns 12 are used to shape a blast in construction, demolition, and mining operations. The drill patterns 12 are established on the basis of a drill pattern plan 14 designed by a drilling and blasting engineer in accordance with well-established models and protocols appropriate for the desired shaped blast.

The drill pattern 12 comprises a plurality of blast holes configured in an array. Respective detonators 30, primers, and a charge of explosives may be loaded into each blast hole 20 and subsequently initiated to create the desired blasting event.

The system 10 includes a plurality of individually identifiable first identifiers 22 and a plurality of GPS devices 24, each GPS device 24 having a GPS device antenna 26. Each blast hole 20 in the drill pattern 12 is provided with a respective first identifier 22 and a GPS device 24.

The first identifier 22 is capable of relaying identification data pertaining to the respective first identifier 22, and by association therewith, the blast hole 20. Additionally, the GPS device 24 is capable of relaying information related to a location of the respective GPS device 24 within the drill pattern 12, and by association therewith, the location of the blast hole 20 within the drill pattern 12.

The first identifier 22 and the GPS device 24 are disposed in a manner in respect to each blast hole 20 such that the identity data corresponding to the first identifier 22 and the location information corresponding to the GPS device correspond specifically with the blast hole 20 with which they are associated. In one embodiment, the first identifier 22 and the GPS device 24 are attached to, or disposed in close proximity with, a blast hole peg (not shown) corresponding to any one or more of the plurality of blast holes 20 in the blast hole drill pattern 12. It will be appreciated that where a drill pattern 12 is established by GPS and blast hole pegs are not used, the first identifier 22 and the GPS device 24 are disposed in the blast hole 20 or in close proximity therewith.

Each detonator 30 loaded into a blast hole 20 in the drill pattern 12 may be provided with a second identifier 32 (as will be described later) which is capable of relaying identification data pertaining to the second identifier 32, and by association therewith, the detonator 30.

The first and second identifiers 22, 32 may be a machine-readable wireless device or transponder (active or passive), such as for example, radio frequency signalling devices, magnetic bar codes, and magnetic induction identification tags. Illustrative examples of radio frequency signalling devices include, but are not limited to, radio frequency identification device (RFID) tags, micro-RFID tags, macro RFID tags, nano-RFID tags, laser RFID tags, active tags, passive tags, and semi passive RFID tags or other suitable RFID tags which are capable of transmitting data to an RFID integration device which can act as a transceiver and receiver. Active RFID tags are tags that contain a battery and can transmit data to a reader. Passive RFID tags are tags that do not contain a battery and cannot transmit data unless interrogated by a RFID integration device. RFID tags can be read-write or read-only tags. An RFID integration device is needed to send a radio frequency signal to a passive RFID tag in order to interrogate it, and may also operate as a reader, which can be both a transmitter and receiver. This signal activates the tag so that it can respond to the reader with the tag information. In this way, the RFID integration device operates as a data collection device by receiving data from the RFID tags. In embodiments that use active RFID tags containing a battery, an RF signal can be sent to the RFID integration device without first having to first transmit an interrogation signal to the RFID. The RFID integration device operates in these scenarios simply as a receiver for collecting the transmitted data.

Regardless of the form which the first or second identifier 22, 32 takes, it will be appreciated that each first identifier 22 and each second identifier 32 has a unique identity. In one form the unique identity of the machine-readable wireless device or transponder comprises a unique machine-readable signal corresponding to a plurality of characters, symbols or other indicia.

For example, the unique machine-readable signal relayed by the first identifier 22 may incorporate information about the specific blast hole 20 with which it is associated and its location according to the drill pattern plan 14. Such information may include the pit number, relative level (RL) number, blast hole location coordinates, and a unique code, which unique code may or may not include a whole number, to identify the blast hole 20.

In one embodiment, the unique machine-readable signal relayed by the second identifier 32 corresponds to 15 characters wherein the first two characters denote a country of origin code, the second two characters denote a manufacturer's code, the third two characters denote a year of manufacture, and the remaining nine characters denote any one of 999,999,999 numerical combinations, for example, AUHE05123456789, to identify that the specific detonator 30 with which the second identifier 32 is associated was manufactured in Australia by the Helidon plant in 2005 and provided with the specific numerical combination of 123456789.

In another embodiment, the unique machine-readable signal relayed by the second identifier 32 corresponds to 128 characters wherein several groups of characters denote codes for:

(a) explosive-type product
(b) chip supplier's information
(c) UN explosive code
(d) country of manufacture
(e) manufacturing plant
(f) product code or material number
(g) batch number
(h) serial number
(i) quantity of units
(j) a read-writable portion for site data entry
(k) shotfire ID number
(l) unique ID number It will be appreciated that the GPS device 24 transmits a unique set of spatial coordinates (x, y, z) for the blast hole 20 with which it is associated. Accordingly, in an alternative embodiment of the invention, the first identifier 22 comprises the GPS device 24. Illustrative examples of GPS devices 24 suitable for use in the present invention include, but are not limited to, a device having a GPS, GPRS, or a cellular modem component, or a combination thereof.

The system 10 also includes a data reception system 40 for receiving identification data and location information from respective first identifiers 22 and GPS devices 24 for each blast hole 20, and for receiving identification data from respective second identifiers 32 associated with the detonator 30 associated with each blast hole 20.

The data reception system 40 includes a master station 16 and one or more one data reception devices 42 adapted for receiving identification data and location information relayed from respective first identifiers 22 and GPS devices 24 for each blast hole 20, and for receiving identification data from respective second identifiers 32 associated with the detonator 30 associated with each blast hole 20. The one or more data reception devices 42 may be located at predetermined locations remote from the drill pattern 12 and/or may be transportable into or out of the drill pattern 12, for example mounted on vehicles and/or personnel operative on site. In a preferred embodiment of the invention the data reception device 42 is an RFID integration device as described previously. It will be appreciated, however, that the data reception device 42 is selected to be suitable for reading the unique machine-readable signal of the machine-readable signal or transponder of the first or second identifier 22, 32. For example, when the first identifier 22 comprises a magnetic bar code, the data reception device 42 comprises a bar code scanner.

The master station 16 includes a master receiver 46 having a master receiver transmitter/receiver antenna 48 for establishing communication with, and receiving identification data and location information, from the one or more data reception devices 42, a master controller 50 including a microcontroller subsystem, a database 52, and a user interface for enabling a user to control and access information from the system 10, and a master global positioning system (GPS) receiver 62 having a GPS antenna for receiving a GPS signal 66 that is continuously broadcast from several GPS satellites and/or GPS pseudolites represented by a GPS satellite 60. The pseudolites may be constructed using terrestrial stations for broadcasting the GPS signal 66 as if they were a GPS satellite. The master GPS receiver 62 processes the GPS signal 62 from at least one, but preferably several, GPS satellites 60 or, optionally, the GPS devices 24 located in the drill pattern 12 for determining the spatial coordinates associated with any one of the plurality of blast holes 20 in the drill pattern 12.

The database 52 stores the drill pattern plan 16 for a particular blasting event, the identification data and location information specific to each blast hole 20 in the drill pattern 12 for the particular blasting event, and the identification data associated with each detonator 30 located in respective blast holes 20 in the drill pattern 12. From this stored information, it is possible for the location and identity of any one particular blast hole 20 in the drill pattern 12 to be remotely identified, and to correlate a specific detonator 30 with its corresponding blast hole 20. The database 52 is also the user interface through which users can inspect data about inventory and history.

It is envisaged that the database 52 will be configured to interface with other computer software used in the construction, demolition, and mining industries, such as for example drilling and blasting software or post-blast software. In this way, for example, it may be possible to run pre-blast reports that can estimate tonnes and grade models, floor location, and visualisers. Given the updated information calculated from such data, it would be possible to more efficiently and effectively allocate resources and equipment prior to loading and hauling blasted material to address issues or problems arising from deviations from anticipated outcomes of the initial models. Further, it would be possible to notify management much earlier of changes in tonnes and material grade for downstream processing purposes.

Figure 2:
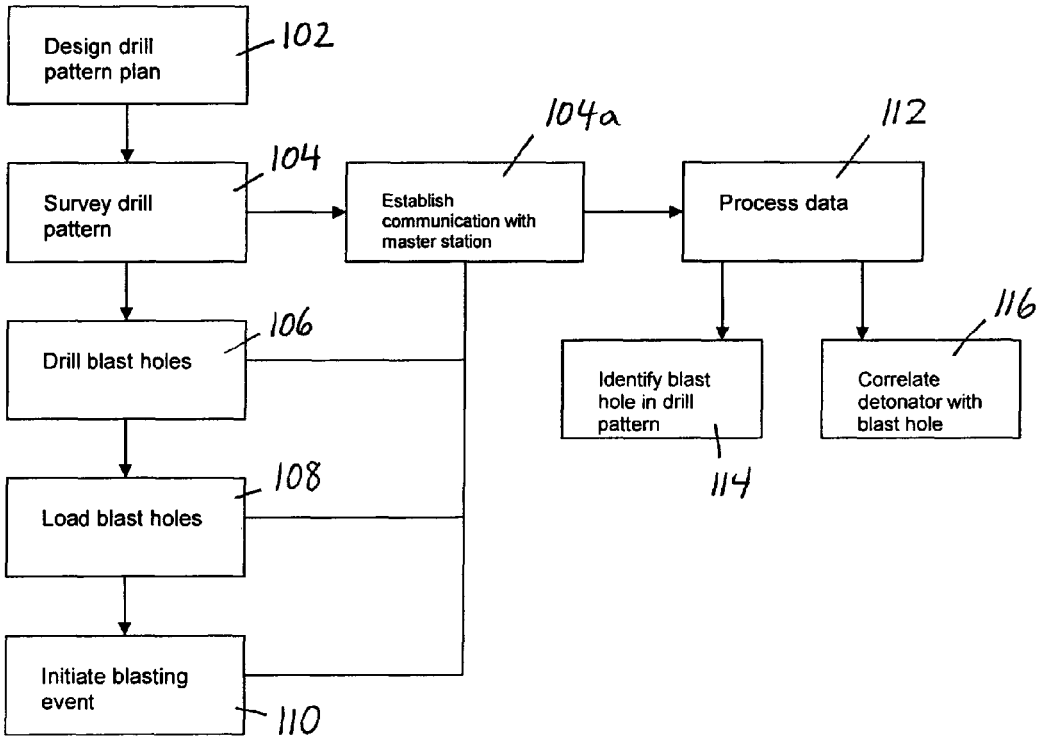
FIG. 2 is a flow chart of the operation of the system of FIG. 1.

FIG. 2 is a flow chart of the operation of the system 10 for remotely identifying any one or more of the plurality of blast holes 20 in the drill pattern 12. The method associated with the system 10 may be readily adapted to additionally correlate any one or more blast holes 20 in the drill pattern 12 with the corresponding detonator 30.

In step 102, the drill pattern plan 14 for a blasting event is designed by the drilling and blasting engineer. Each proposed blast hole 20 in the drill pattern plan 14 is allocated a first identifier 22 having a unique identity.

In step 104, the drill pattern 12 is then surveyed, optionally via the proposed spatial coordinates of the blast hole 20 and GPS, and optionally pegged out with a plurality of blast hole pegs, each blast hole peg marking the location of a proposed blast hole 20 in the drill pattern 12. The terms "blast hole peg" or "pegged out" will also be understood to mean a type of or use of a marker, such as a paint mark, flagging tape or other visible marker to indicate the location of the blast hole 20. During this process the surveyor disposes the respective first identifier 22 allocated for each one of the plurality of blast holes 20 and a GPS device 24 in a manner in respect to the corresponding blast hole 20 such that the first identifier 22 and the GPS device 24 are capable of relaying respective identity and location information to the one or more data reception devices 42 and the master GPS receiver 62 via GPS satellite 60. Preferably, the first identifier 22 and the GPS device 24 are disposed in close proximity to the blast hole peg. Even more preferably, the first identifier 22 and the GPS device 24 are fixed to the blast hole peg.

While the drill pattern 12 is supposed to conform closely to the drill pattern plan 14, in practice it is not always practical or possible to locate the blast holes in the exact locations proposed by the drill pattern plan 14. Advantageously, in step 104*a* communication may be established with the master station 16 via the one or more data reception devices 42 once the blast holes 20 have a respective first identifier 22 and GPS devices 24 associated therewith. In this way, the identity and location information of each blast hole 20 surveyed in the drill pattern 12 can be relayed in real time to the master station 16 in step 104, and processed by the master controller 50 in step 112, optionally in interface with modelling software for the design of controlled and shaped blasting events. The remote identification of any one of the blast holes 20 in the drill pattern 12 is thus able to be determined in step 114 and updates to blasting plans can be produced to account for deviations from the intended locations of blast holes 20 in the drill pattern plan 14.

It will be appreciated that while one or more data reception devices 42 may be located permanently throughout the vicinity of the blasting event site, the data reception devices 42 may be mounted on vehicles or any operators, such as, for example, the surveyors, drilling crew, shot loading crew, and so on, operating in the vicinity of the drill pattern 12 itself. In particular, it is also envisaged that the data reception devices 42 are capable of receiving and storing information entered by the operator, and the combined data may be transferred by means of a data transfer protocol to the master station 16 at a later time, for example at the end of the shift, or in real time.

In step 106, the driller drills the plurality of blast holes 20 in accordance with the drill pattern plan 14 and as marked out by the plurality of corresponding blast hole pegs, or other means for locating the blast holes 20 within the drill pattern 12. At this stage, the driller may enter additional information about the blast holes 20 into the data reception devices 42, including the depth and diameter of individual blast holes 20. Once again, this information may be relayed back to the master station 16 and processed as described previously.

Then in step 108, each blast hole 20 is loaded with explosive material, primers, and the detonator 30 by a shot crew or similar operators. Preferably, the detonator 30 is provided with at least one individually identifiable second identifier 32 with unique identity data, the second identifier 32 being of a type similar to the first identifier 22 associated with the corresponding blast hole 20. At this stage, the shot crew may enter additional information associated with the provenance and movement of the detonator 30 including, but not limited to, type of explosive and the mass of explosives loaded into the blast hole 20, loading date and time, identity of personnel responsible for loading the blast hole 20, magazine location, type of detonator 30, details associated with withdrawal of the detonator 30 from the magazine, replenishment of the magazine with a plurality of detonators 30, etc. Once again, this information may be relayed back to the master station 16 and processed as described previously in step 112.

The specific identity of the detonator 30 and the additional information may be recorded and stored on the database 52 of the master station 16. The stored identity data of the detonator 30 and the corresponding blast hole 20 is then provided to the drilling and blasting engineer who downloads the data. In step 116, the data is provided in a format to allow ready correlation between the identity data recorded and stored corresponding to the blast hole 20 and the identity data recorded and stored corresponding to the detonator 30. For example, identity data pertaining to the blast holes 20 and the detonators 30 can be correlated on a simple spread sheet on the basis of the number of blast holes loaded with explosives and detonators, the location of the detonators, etc.

In step 110 the blasting event is initiated according to conventional practices. After the completion of the blasting event, blast hole samples may be collected and forwarded to a laboratory for analysis purposes. If two identical second identifiers 32 are provided to the detonator 30 for each blast hole 20, then one of the two identical second identifiers 32 can accompany the blast hole samples to the laboratory in order to provide ready identification of the identity of the blast hole 20 from which the blast hole sample is taken, and later to provide identity date for correlation purposes with information collected by the blasting crew, as per step 116.

Figure 3:
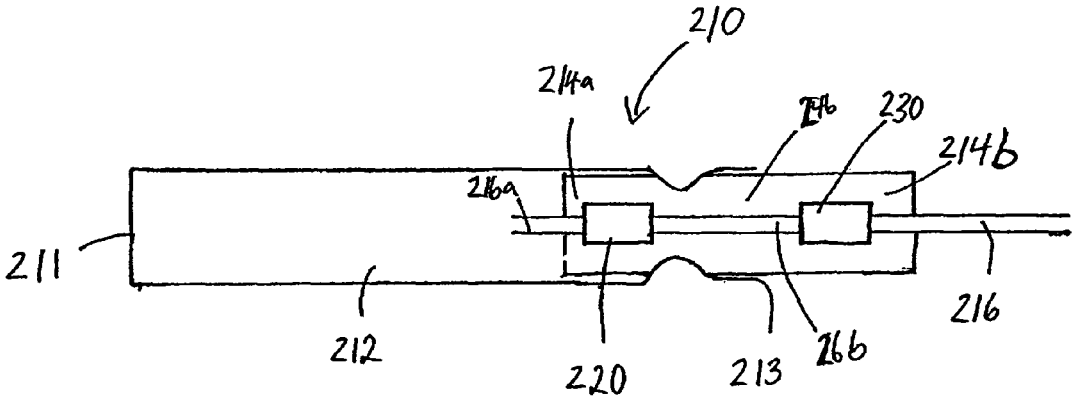
FIG. 3 shows a diagrammatic view of a detonator used in accordance with the present invention.

In the preferred embodiment, the detonator 30 is provided with two second identifiers 32 as described previously. Preferably, both second identifiers 32 are identical and unique to the detonator 30. Referring to FIG. 3, the detonator 30 typically comprises a detonator casing 212 for housing a detonator mechanism (not shown). In this particular embodiment the detonator casing 212 is a cylinder formed from a metal or alloy, such as aluminium or steel, with a closed end 211 and an open end 213. A hollow cylindrical seal 214 provided with a detonation initiation means 216 concentrically disposed therein is inserted into the open end 213. The detonation initiation means 216 is of a type suitable to initiate detonation of the detonator mechanism and typically comprises a detonation cord, electric wires or, more preferably, a length of NONEL™ tubing. The detonator mechanism and detonation initiation means 216 will be well known to those skilled in the art.

Typically, a portion of the cylindrical seal 214*a* and the detonation initiation means 216*a* is disposed internally in the detonator casing 212 and a remaining portion of the cylindrical seal 214*b* and the detonation initiation means 216*b* is disposed externally of the open end 213. The open end 213 of the detonator casing 212 is tightly crimped over the seal 214 to prevent the detonation initiation means 216 from being removed from the detonator casing 212 and to seal the detonator mechanism from contamination with moisture, grease, and dust.

The detonator 30 is further provided with an internal identifier 220 and an external identifier 230. In the embodiment shown in FIG. 3 the internal identifier 220 is mounted on, or embedded in, the portion of the cylindrical seal 214*a* disposed internally of the detonator casing 212 and the external identifier 230 is mounted on, or embedded in, the portion of the cylindrical seal 214*b* disposed externally of the detonator casing 212.

Advantageously, if the portion of the cylindrical seal 214*b* disposed externally of the detonator casing 212 is removed from the detonator casing 212 or damaged, the detonator 30 may still be identified by the internal identifier 220 disposed within the detonator casing 212. It is envisaged that the detonator casing 212 may first have to be opened in order to access the internal identifier 220, in which case the detonator 30 may not be used further.

It is to be understood that, although prior art use and publications may be referred to herein, such reference does not constitute an admission that any of these form a part of the common general knowledge in the art, in Australia or any other country.

For the purposes of this specification it will be clearly understood that the word "comprising" means "including but not limited to", and that the word "comprises" has a corresponding meaning.

Numerous variations and modifications will suggest themselves to persons skilled in the relevant art, in addition to those already described, without departing from the basic inventive concepts. All such variations and modifications are to be considered within the scope of the present invention, the nature of which is to be determined from the foregoing description.

The claims defining the invention are as follows:

1. A system of correlating any one or more of a plurality of blast holes in a drill pattern with a corresponding detonator, the system comprising:

a) a plurality of individually identifiable first identifiers capable of relaying identification data pertaining to the respective first identifier;

b) a plurality of GPS devices capable of relaying information related to a location of the respective GPS device;

c) a plurality of blast holes configured in a drill pattern, each blast hole being provided with a respective first identifier and a GPS device;

d) a plurality of individually identifiable second identifiers capable of relaying identification data pertaining to the respective second identifier;

e) a plurality of detonators, each detonator being provided with a respective second identifier, wherein each detonator is located in a respective blast hole in the drill pattern; and, f) a data reception system for receiving identification data and location information from respective first and second identifiers and GPS devices for each blast hole and corresponding detonator.

2. The system according to claim 1, wherein the first and the second identifiers comprise a machine-readable wireless device or transponder.

3. The system according to claim 2, wherein the first and second identifiers comprise radio frequency signalling devices, magnetic bar codes, and magnetic induction identification tags.

4. The system according to claim 1, wherein each of the first and second identifiers has a unique identity.

5. The system according to claim 4, wherein the unique identity of the machine-readable wireless device or transponder comprises a unique machine-readable signal corresponding to a plurality of characters, symbols or other indicia.

6. The system according to claim 1, wherein the first identifier and the GPS device are disposed in a manner with respect to each blast hole such that the identity data corresponding to the first identifier and the location information corresponding to the GPS device correspond specifically with the blast hole.

7. The system according to claim 6, wherein the first identifier and the GPS device are attached to, or disposed in close proximity with, a blast hole peg corresponding to any one or more of the plurality of blast holes in the blast hole drill pattern.

8. The system according to claim 1, wherein the detonator comprises a detonator casing for housing a detonator mechanism and the second identifier, wherein the second identifier comprises an internal identifier disposed internally of the detonator casing and an external identifier disposed externally of the detonator casing.

9. The system according to claim 8, wherein the internal and external identifiers are identical and unique to the detonator.

10. The system according to claim 1, wherein the data reception system comprises one or more data reception devices adapted for receiving identification data and location information relayed from respective first identifiers and GPS devices for each blast hole and from respective second identifiers for each detonator.

11. The system according to claim 10, wherein the one or more data reception devices may be located at predetermined locations remote from the blast hole drill pattern and/or may be transportable into or out of the blast hole drill pattern.

12. The system according to claim 10, wherein the data reception system further comprises a database capable of receiving and storing identification data and location information transmitted from the one or more data reception devices.

13. A method of correlating any one or more of a plurality of blast holes in a drill pattern with a corresponding detonator, the method comprising:

a) providing each of a plurality of blast holes with an individually identifiable first identifier capable of relaying identification data pertaining to the respective blast hole;

b) providing each of the plurality of blast holes with a GPS device capable of relaying information related to a location of the respective blast hole;

c) providing a detonator corresponding to each of the plurality of blast holes with an individually identifiable second identifier;

d) receiving identification data and location information from said first identifier and GPS device, respectively, at a first data reception device;

e) receiving identification data from said second identifier at the first data reception device; and f) correlating the identification data and location information pertaining to each blast hole with the identification data pertaining to each corresponding detonator.

14. A computer program product comprising a non-transitory computer-readable storage medium having computer-readable program instructions stored therein, the computer-readable program instructions comprising program instructions configured to cause an apparatus to perform a method of correlating any one or more of a plurality of blast holes in a drill pattern with a corresponding detonator, the method comprising:

a) receiving identification data and location information from a first identifier and a GPS device associated with any one of a plurality of blast holes in a drill pattern;

b) receiving identification data from a second identifier associated with a detonator located in any one of the plurality of blast holes in the drill pattern; and c) correlating the identification data and location information pertaining to each blast hole with the identification data pertaining to each corresponding detonator.

* * * * *